US005921039A

United States Patent [19]

Sanders

[11] Patent Number: 5,921,039

[45] Date of Patent: Jul. 13, 1999

[54] PREFABRICATED DOOR FRAME ASSEMBLY

[76] Inventor: Douglas Sanders, Rte. 1, Box 157-D, Winnsboro, S.C. 29180

[21] Appl. No.: 08/936,952

[22] Filed: Sep. 25, 1997

[51] Int. Cl.[6] ..... E06B 1/04

[52] U.S. Cl. ..... 52/210; 49/504; 52/211; 52/215; 52/656.4

[58] Field of Search ..... 49/501, 504; 52/210, 52/211, 213, 215, 241, 656.2, 656.4

[56] References Cited

U.S. PATENT DOCUMENTS

| | | | |
|---|---|---|---|
| 2,919,477 | 1/1960 | Schacht | 52/211 |
| 3,224,533 | 12/1965 | Nystrom | 52/210 X |
| 3,593,473 | 7/1971 | King | 52/211 |
| 3,774,360 | 11/1973 | Hubbard et al. | 52/656.4 X |
| 3,811,238 | 5/1974 | Brinker | 52/211 |
| 5,465,540 | 11/1995 | Biernazki | 52/211 |

*Primary Examiner*—Carl D. Friedman
*Assistant Examiner*—Kevin D. Wilkens

[57] ABSTRACT

A new prefabricated door frame assembly for ready on site adaptation and attachment to a structure. The inventive device includes an inner door frame, for mounting a door thereon, surrounded by an outer framing frame, for attachment to a structure, with a pair of side glass panels each shaped to fit between the sides of the door frame and the framing frame, and a transom glass panel between the top of the door frame and the framing frame.

1 Claim, 2 Drawing Sheets

PREFABRICATED DOOR FRAME ASSEMBLY

BACKGROUND OF THE INVENTION

1. Related Data

The subject matter of the present utility patent application has been registered with the United States Patent and Trademark Office under the disclosure document program. The request was received at the United States Patent and Trademark Office on Nov. 26, 1993 and was assigned the registration number 343521.

2. Field of the Invention

The present invention relates to frame assemblies and more particularly pertains to a new prefabricated door frame assembly for ready on site adaptation and attachment to a structure.

3. Description of the Prior Art

The use of frame assemblies is known in the prior art. More specifically, frame assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art frame assemblies include U.S. Pat. No. 4,489,517; U.S. Pat. No. 5,088,255; U.S. Pat. No. Des. 270,477; U.S. Pat. No. 5,203,132; U.S. Pat. No. Des. 265, 931; and U.S. Pat. No. Des. 260,438.

While these devices fulfill their respective, particular objectives and requirements, the aforementioned patents do not disclose a new prefabricated door frame assembly. The inventive device includes an inner door frame, for mounting a door thereon, surrounded by an outer framing frame, for attachment to a structure, with a pair of side glass panels each shaped to fit between the sides of the door frame and the framing frame, and a transom glass panel between the top of the door frame and the framing frame.

In these respects, the prefabricated door frame assembly according to the present invention substantially departs from the conventional concepts and designs of the prior art, and in so doing provides an apparatus primarily developed for the purpose of ready on site adaptation and attachment to a structure.

SUMMARY OF THE INVENTION

In view of the foregoing disadvantages inherent in the known types of frame assemblies now present in the prior art, the present invention provides a new prefabricated door frame assembly construction wherein the same can be utilized for ready on site adaptation and attachment to a structure.

The general purpose of the present invention, which will be described subsequently in greater detail, is to provide a new prefabricated door frame assembly apparatus and method which has many of the advantages of the frame assemblies mentioned heretofore and many novel features that result in a new prefabricated door frame assembly which is not anticipated, rendered obvious, suggested, or even implied by any of the prior art frame assemblies, either alone or in any combination thereof.

To attain this, the present invention generally comprises an inner door frame, for mounting a door thereon, surrounded by an outer framing frame, for attachment to a structure, with a pair of side glass panels each shaped to fit between the sides of the door frame and the framing frame, and a transom glass panel between the top of the door frame and the framing frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new prefabricated door frame assembly apparatus and method which has many of the advantages of the frame assemblies mentioned heretofore and many novel features that result in a new prefabricated door frame assembly which is not anticipated, rendered obvious, suggested, or even implied by any of the prior art frame assemblies, either alone or in any combination thereof.

It is another object of the present invention to provide a new prefabricated door frame assembly which may be easily and efficiently manufactured and marketed.

It is a further object of the present invention to provide a new prefabricated door frame assembly which is of a durable and reliable construction.

An even further object of the present invention is to provide a new prefabricated door frame assembly which is susceptible of a low cost of manufacture with regard to both materials and labor, and which accordingly is then susceptible of low prices of sale to the consuming public, thereby making such prefabricated door frame assembly economically available to the buying public.

Still yet another object of the present invention is to provide a new prefabricated door frame assembly which provides in the apparatuses and methods of the prior art some of the advantages thereof, while simultaneously overcoming some of the disadvantages normally associated therewith.

Still another object of the present invention is to provide a new prefabricated door frame assembly for ready on site adaptation and attachment to a structure.

Yet another object of the present invention is to provide a new prefabricated door frame assembly which includes an inner door frame, for mounting a door thereon, surrounded by an outer framing frame, for attachment to a structure, with a pair of side glass panels each shaped to fit between the sides of the door frame and the framing frame, and a transom glass panel between the top of the door frame and the framing frame.

Still yet another object of the present invention is to provide a new prefabricated door frame assembly that provides a prefabricated decorative exterior doorway to a structure.

Even still another object of the present invention is to provide a new prefabricated door frame assembly that fabricated out of any appropriate wood or metal materials.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
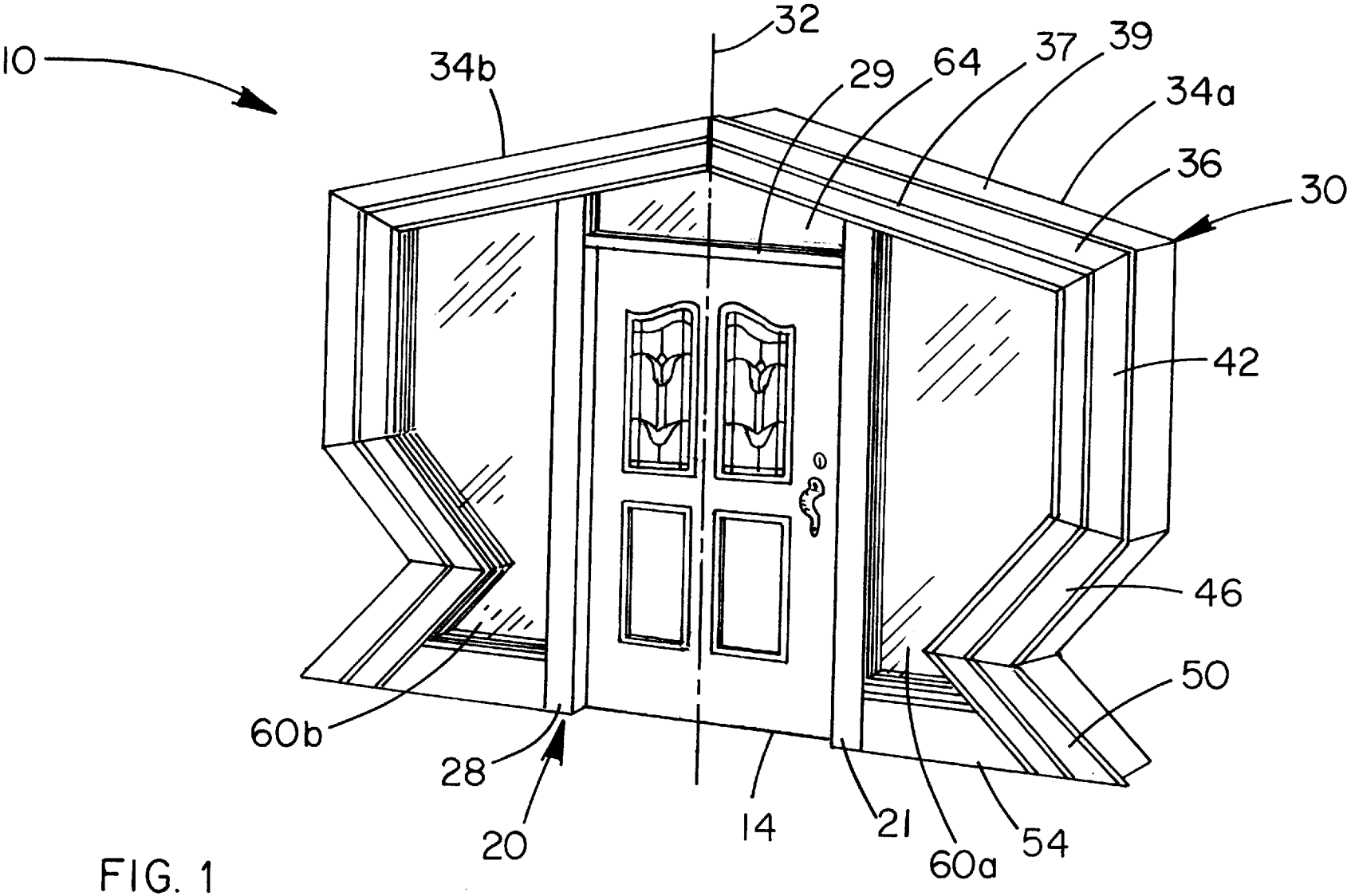
FIG. 1 is a front perspective view of a new prefabricated door frame assembly according to the present invention.
Figure 2:
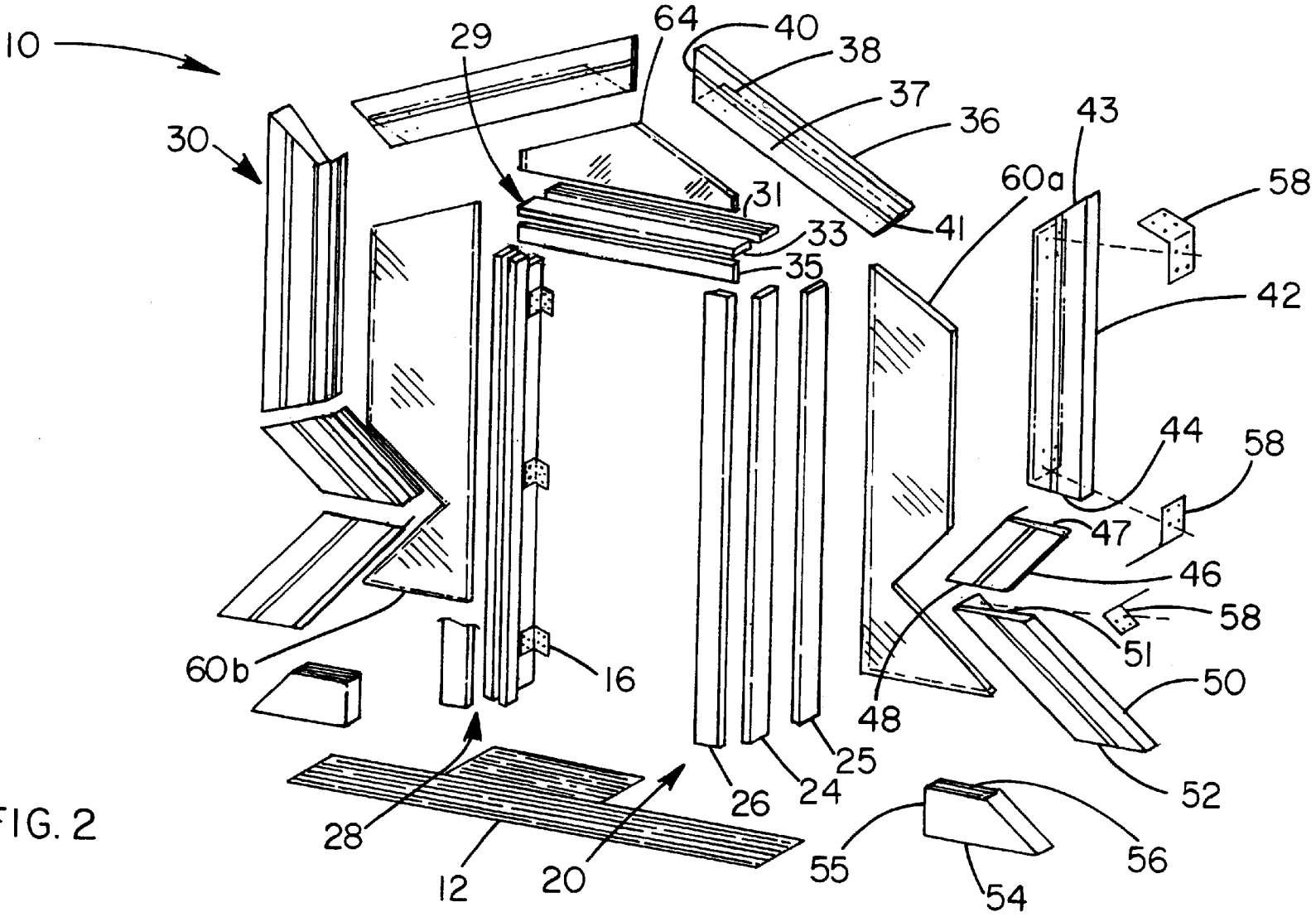
FIG. 2 is a front exploded view of the present invention.

With reference now to the drawings, and in particular to FIGS. 1 through 2 thereof, a new prefabricated door frame assembly embodying the principles and concepts of the present invention and generally designated by the reference numeral 10 will be described.

As best illustrated in FIGS. 1 through 2, the prefabricated door frame assembly 10 comprises an inner door frame 20 surrounded by an outer framing frame 30 with a pair of side glass panels 60*a,b* each shaped to fit between the sides of the door frame 20 and the framing frame 30, and a transom glass panel 64 between the top of the door frame 20 and the framing frame 30.

The outer framing frame 30 is designed for permitting easy installation of the invention in a building. The framing frame 30 has a central vertical axis of symmetry 32 that divides the framing frame 30 into a pair of substantially similar side sections 34*a,b*. The side sections 34*a,b* are aligned in an opposing symmetrical relationship to each other. Also, each of the side sections 34*a,b* extends outwardly and downwardly from the central vertical axis of symmetry 32.

Each side section 34*a,b* is made of several elongate parts or members. Each side section 34*a,b* includes a top member 36, a vertical member 42, an outward angle member 46, an inward angle member 50, a side panel member 54. The top member 36, the vertical member 42, the outward angle member 46, the inward angle member 50 all have a brick mold portion, a glass jamb portion, and an outer jamb portion. Illustratively, the top member 36 has a top member brick mold portion 37, a top member glass jamb portion 38, and an top member outer jamb portion 39. The brick mold portion 37 serves as the outer facing of each member. The glass jamb provides a surface for holding the glass panels 60*a,b,*64 in place between the framing frame 30 and the door frame 20. The outer jamb portion provides a surface to attach the framing frame 30 to a structure.

With reference to FIG. 1, the first ends 40 of each side section's 34*a,b* top member 36 are coupled together to form the top of the framing frame 30. The top member second end 41 of each side section is 34*a,b* is coupled to its corresponding vertical member top end 43. The outward angle member top end 47 is attached to the vertical member bottom end 44. The outward angle member bottom end 48 is coupled to the inward angle member top end 51 which is positioned opposite of inwardly angle bottom end 52. The side panel member second end 56 is attached to the inward angle member 50 to complete structure of the side section 34*a*. For further reinforcement to the framing frame 30, a support plate brace 58 may included at each of the joints between the members.

The two side sections 34*a,b* are also connected together by an elongate threshold 12 which extends between the side panel member 54 of each the side section 34*a,b*. The threshold 12 helps connect the elements of the prefabricated door frame assembly 10 and provides a bottom support for the invention.

The inner door frame 20 is designed for mounting a hinged door on it. The door frame 20 is surrounded by the framing frame 30. The door frame 20 is centered between the side sections 34*a,b*. The door frame also provides additional structural support to the framing frame 30. The door frame 20 includes a pair of substantially similar elongate side member 21,28 and a transom member 29 extending between the side members 21,28. The transom member 29 is preferably comprised of three components 31, 33 and 35.

The top end of each of the side members 21,28 is attached to a top members 36 to provide a structural connection between the door frame 20 and the framing frame 30. Similarly, the bottom ends of the side members 21,28 are attached to the threshold 12. Also, the first end 55 of each side panel member 54, is attached to their respective side's side member 21,28 to further provide additional structural strength to the invention.

Each member 21,28,29 of the door frame 20 has a door jamb portion, a glass jamb portion, and a front mullion portion. Illustratively, with reference to FIG. 2, the first side member 21 has a door jamb portion 24, a glass jamb portion 25, and a front mullion portion 26.

The side glass panels 60*a,b* extend between their respective side members 21,28 of inner door frame 20 and the respective section 34*a,b* of the outer framing frame 30. The side glass panels 60*a,b* are shaped to fit against the glass jamb portions 25,38 of both the side member 21,28 and the members of the framing frame 30. Similarly, the transom glass panel 64 is extended horizontally to fit between the first side member 21 and the second side member 28 and also extends vertically to fit between the transom member 29 and the top members 36 of the outer framing frame 30.

In use, the prefabricated door frame assembly 10 may optionally include a door 14 already hinge mounted 16 to the door frame 20. The framing frame 30 is attachable to structures to incorporate the prefabricated door frame assembly 10 into the structure to provide a decorative doorway to the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A prefabricated door frame assembly, comprising:

an outer framing frame for attachment to a structure, said outer framing frame having a central vertical axis of symmetry, and a pair of substantially similar side sections in opposed symmetrical relationship to each other, each said side section comprising:

an elongate top member having an angled first end, an angled second end, a brick mold portion, a glass jamb portion, and an outer jamb portion, said top member second end being extended outwardly and downwardly from said central vertical axis of symmetry;

an elongate vertical member having an angled top end, an angled bottom end, a brick mold portion, a glass jamb portion, and an outer jamb portion, said vertical member top end being coupled to said top member second end via an angled support plate brace;

an elongate outward angle member having an angled top end, an angled bottom end, a brick mold portion, a glass jamb portion, and an outer jamb portion, said outward angle member top end being coupled to said vertical member bottom end via an angled support plate brace;

an elongate inward angle member having an angled top end, an angled bottom end, a brick mold portion, a glass jamb portion, and an outer jamb portion, said inward angle member top end being coupled to said outward angle member bottom end via an angled support plate brace; and an elongate side panel member having a first end, a second end, a brick mold portion, a glass jamb portion, and an outer jamb portion, said side panel member second end being coupled to said inward angle member bottom end;

wherein each said side section being extended outward from said central vertical axis of symmetry of said outer framing frame;

wherein said top member first end of a first one of said side sections being coupled to said top member first end of a second one of said side sections;

an elongate threshold being extended between each said side panel member of each said side section;

an inner door frame for mounting a door thereon, said inner door frame being positioned substantially center between said side sections, said door frame comprising:

an elongate first side member having a top end, a bottom end, a door jamb portion, a glass jamb portion, and a front mullion portion, said first side member top end being coupled to a first one of said top members, said first side member being coupled to said first side section side panel member first end, said first side member bottom end being coupled to said threshold;

an elongate second side member having a top end, a bottom end, a door jamb portion, a glass jamb portion, and a front mullion portion, said second side member top end being coupled to a second one of said top members, said second side member being coupled to said second side section side panel member first end, said second side member bottom end being coupled to said threshold; and an elongate transom member having a door jamb portion, a glass jamb portion, and a front mullion portion, said transom member being extended between said first side member and said second side member;

a first side glass panel being extended between said inner door frame and said first side section of said outer framing frame with a substantially triangular cut out formed in an outboard edge thereof;

a second side glass panel being extended between said inner door frame and said second side section of said outer framing frame with a substantially triangular cut out formed in an outboard edge thereof; and a substantially triangular transom glass panel being extended between said first side member and said second side member and being extended between said transom member and said outer framing frame.

* * * * *